US012605582B2

(12) United States Patent
Dunbar et al.

(10) Patent No.: US 12,605,582 B2
(45) Date of Patent: Apr. 21, 2026

(54) ADJUSTABLE CENTER-MASS WEIGHT ASSEMBLY

(71) Applicant: .50 Cal Fitness, LLC, Edna, TX (US)

(72) Inventors: Derek J. Dunbar, Edna, TX (US); Cody W. Engelmohr, Louise, TX (US); Zachary T. Hall, New Kensington, PA (US)

(73) Assignee: .50 Cal Fitness, LLC, Edna, TX (US)

( * ) Notice: Subject to any disclaimer, the term of this patent is extended or adjusted under 35 U.S.C. 154(b) by 55 days.

(21) Appl. No.: 18/420,292

(22) Filed: Jan. 23, 2024

(65) Prior Publication Data

US 2025/0235734 A1 Jul. 24, 2025

Related U.S. Application Data

(60) Provisional application No. 63/471,957, filed on Jun. 8, 2023.

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0726; A63B 21/072–075
See application file for complete search history.

(56) References Cited

U.S. PATENT DOCUMENTS

| | | | | | |
|---|---|---|---|---|---|
| D302,195 | S * | 7/1989 | Orak | D21/682 | |
| D307,168 | S * | 4/1990 | Vodhanel | D21/682 | |
| D372,945 | S * | 8/1996 | Morgan | D21/682 | |
| 6,500,101 | B1 * | 12/2002 | Chen | A63B 21/072 | 482/107 |
| 7,011,611 | B1 * | 3/2006 | Ripley | A63B 21/0728 | 482/107 |
| D762,788 | S * | 8/2016 | Slowey | D21/683 | |
| 10,569,120 | B2 * | 2/2020 | Sorin | A63B 21/4035 | |
| D887,503 | S * | 6/2020 | Ford | D21/678 | |
| D895,740 | S * | 9/2020 | Lovegrove | D21/680 | |
| 2003/0207740 | A1 * | 11/2003 | Fenelon | A63B 21/0601 | 482/107 |
| 2014/0031177 | A1 * | 1/2014 | Wang | A63B 21/075 | 482/107 |
| 2014/0243168 | A1 * | 8/2014 | Razzaq | A63B 21/0726 | 482/106 |
| 2016/0317857 | A1 * | 11/2016 | Sorin | A63B 21/072 | |
| 2022/0096890 | A1 * | 3/2022 | Lu | A63B 21/0728 | |

(Continued)

*Primary Examiner* — Megan Anderson
*Assistant Examiner* — Catrina A Letterman
(74) *Attorney, Agent, or Firm* — Harness, Dickey & Pierce, P.L.C.

(57) ABSTRACT

The present invention relates to an adjustable center-mass weight assembly including a plurality of substantially concentric weights engaged by one or more capturing rods which can be extended from or retracted into a rotatable handle. As the handle is rotated in a first direction, the rods extend through consecutive weights to add weight and by rotating the handle in a second direction weight can be removed from the weight package. The weights can come in a variety of shapes but preferably they will be in the shape of cylinders, squares, or hexagons, for example, such that by disposing the handle across a central axis the weight can be centered.

26 Claims, 13 Drawing Sheets

(56) References Cited

U.S. PATENT DOCUMENTS

| | | | | |
|---|---|---|---|---|
| 2023/0027679 | A1* | 1/2023 | Chen | A63B 21/075 |
| 2024/0366989 | A1* | 11/2024 | Hara | A63B 21/075 |
| 2024/0408434 | A1* | 12/2024 | Liu | A63B 71/0036 |

* cited by examiner

ADJUSTABLE CENTER-MASS WEIGHT ASSEMBLY

CROSS-REFERENCE TO RELATED APPLICATIONS

This application claims the benefit of U.S. Provisional Application No. 63/471,957, filed on Jun. 8, 2023. The entire disclosure of the above application is incorporated herein by reference.

FIELD

This invention relates to fitness equipment generally, and more particularly to an adjustable center-mass weight assembly. The adjustable center-mass weight assembly allows users to easily select and modify the weight package to suit their strength levels and exercise requirements.

BACKGROUND

Traditional weight structures such as dumbbell sets consist of various individual dumbbells with fixed weights. Often users would need to purchase multiple dumbbells of different weights to accommodate their workout regimen. This results in increased cost, storage space, and inconvenience. Some prior art attempts at adjustable dumbbells exist, but these suffer from various drawbacks such as complicated weight adjustment mechanisms or unstable designs. Thus, there is a need for a highly functional, easy to use, and cost effective weight assembly.

SUMMARY

This section provides a general summary of the disclosure, and is not a comprehensive disclosure of its full scope or all of its features.

The adjustable center-mass weight assembly embodiments disclosed herein provides an innovative solution that overcomes the limitations of the prior art by offering a user-friendly and stable adjustable system, allowing individuals to easily change the weight according to their specific physical abilities and exercise goals. The adjustable center-mass weight assembly of the present invention includes as the main components a plurality of interchangeable weights and a selectively rotatable handle assembly including a mechanism for adding or removing weights during use. The assembly also includes a storage cradle for hosting the interchangeable weights and handle. As will be described in greater detail below, the cradle cooperates with the handle assembly to allow for rotation of the handle to either add or remove weights to and from the handle while the handle is engaged in the cradle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
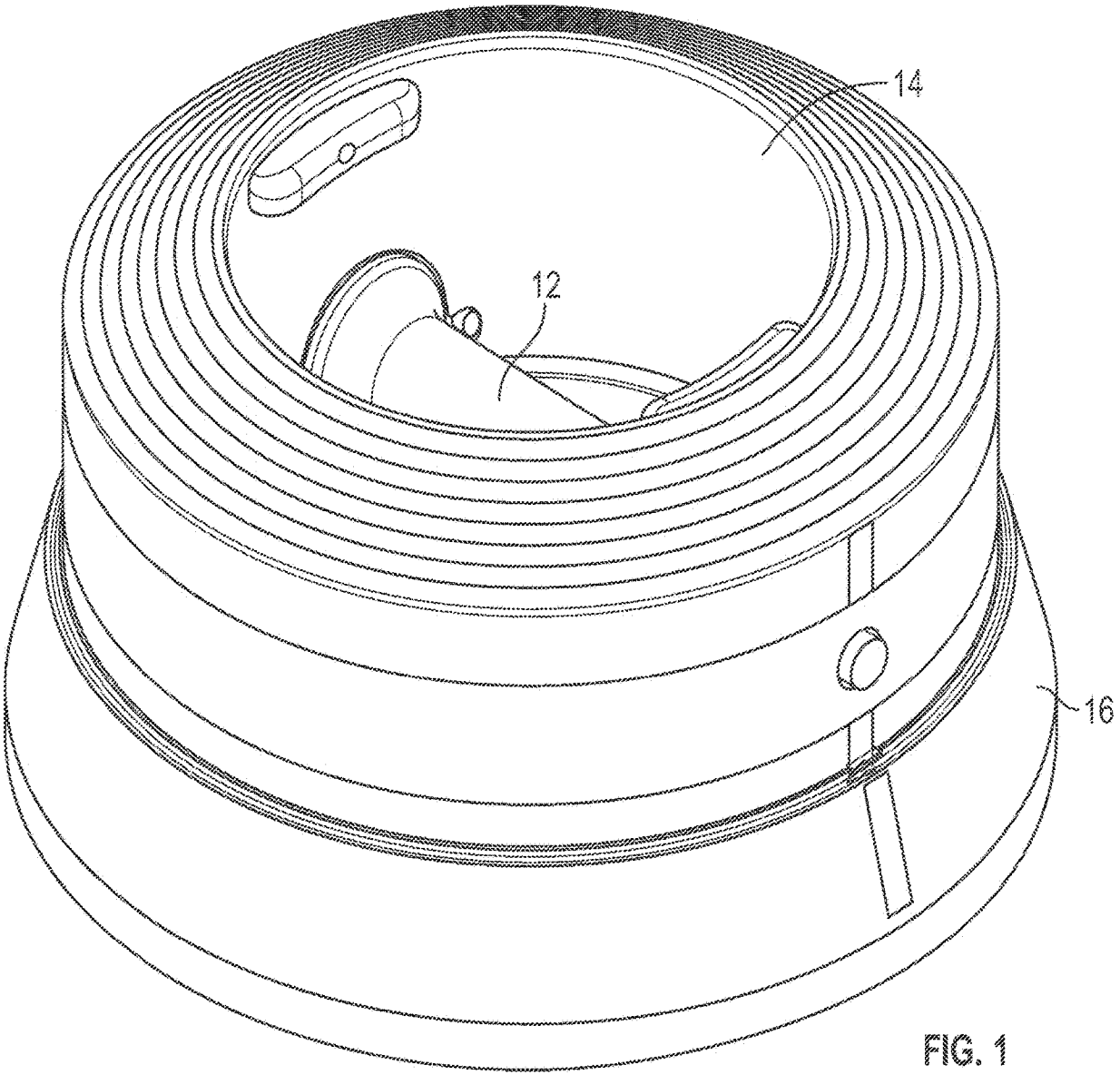
FIG. 1 is an assembled perspective view of an adjustable center-mass weight assembly according to the present invention.

The following detailed description refers to the drawings which depict certain embodiments of the adjustable dumbbell set according to the present invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "center-mass" is intended to mean that the weight package relative to the handle is essentially evenly distributed horizontally and vertically.

The terms "concentric" or "concentrically" are intended to mean that the weights of the weight package have a shape which defines an essentially common central portion regardless of the overall shape, i.e. circular or rectangular, for example.

The terms "tubular" or "substantially tubular" are intended to mean a partially or fully enclosed design having at least one accurate angled inner wall regardless of the overall shape, i.e. circular or rectangular, for example.

Referring to FIGS. 1-10, the major components of the adjustable center-mass weight assembly are shown. The main components include a weight package 14, otherwise referred to herein as a weight stack, including a plurality of concentrically arranged weights 14A-141, for example, a selectively rotatable handle assembly 12; and a cradle 16 for hosting the weight package and handle assembly.

Figure 2:
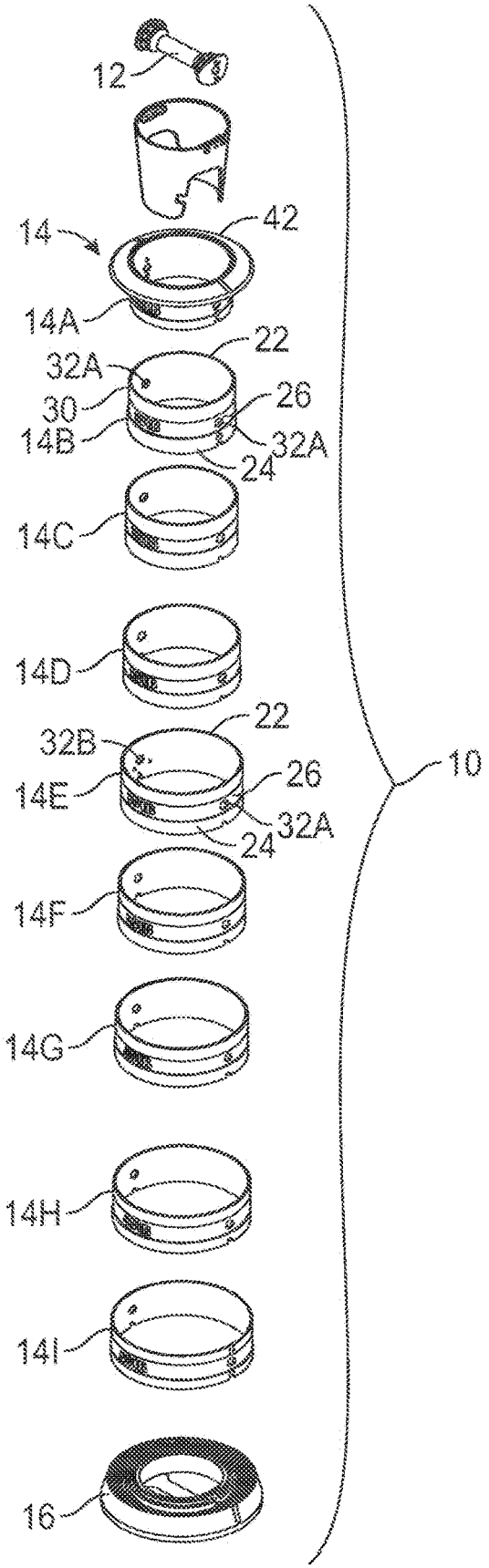
FIG. 2 is an exploded perspective view of an adjustable center-mass weight assembly according to the present invention.
Figure 3:
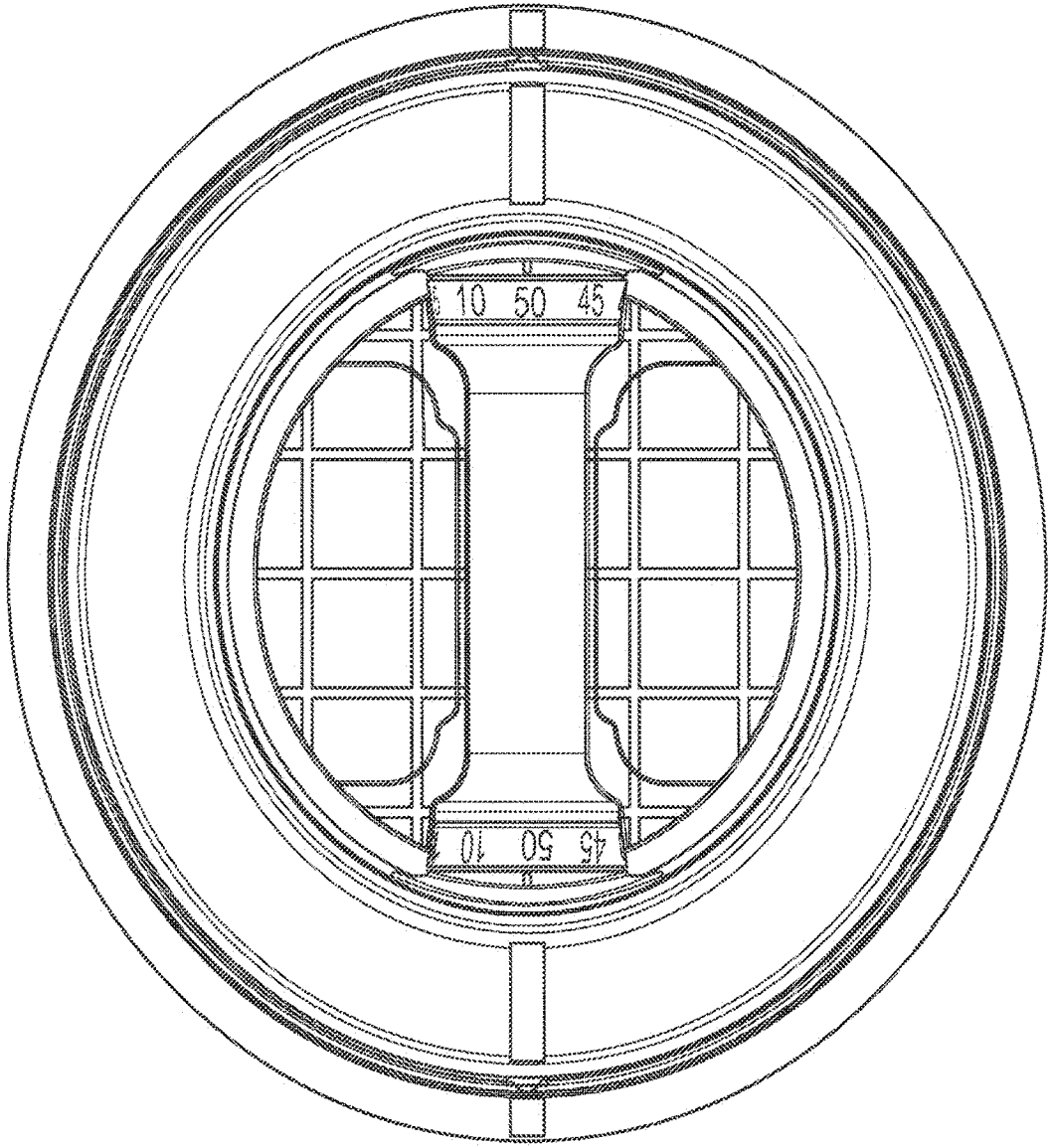
FIG. 3 is a top view of an adjustable center-mass weight assembly according to the present invention.
Figure 4:
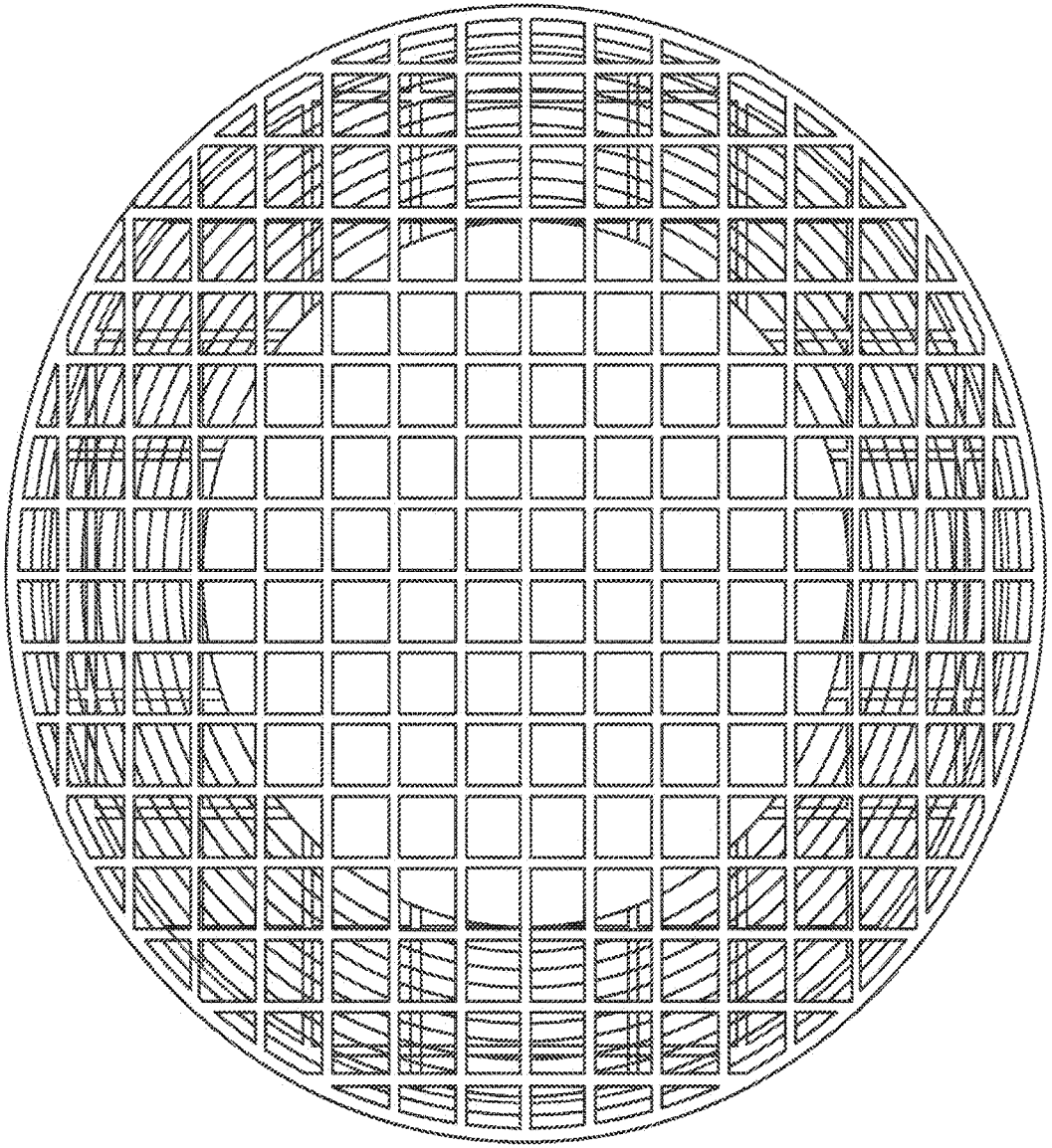
FIG. 4 is a bottom view of an adjustable center-mass weight assembly according to the present invention.
Figure 11:
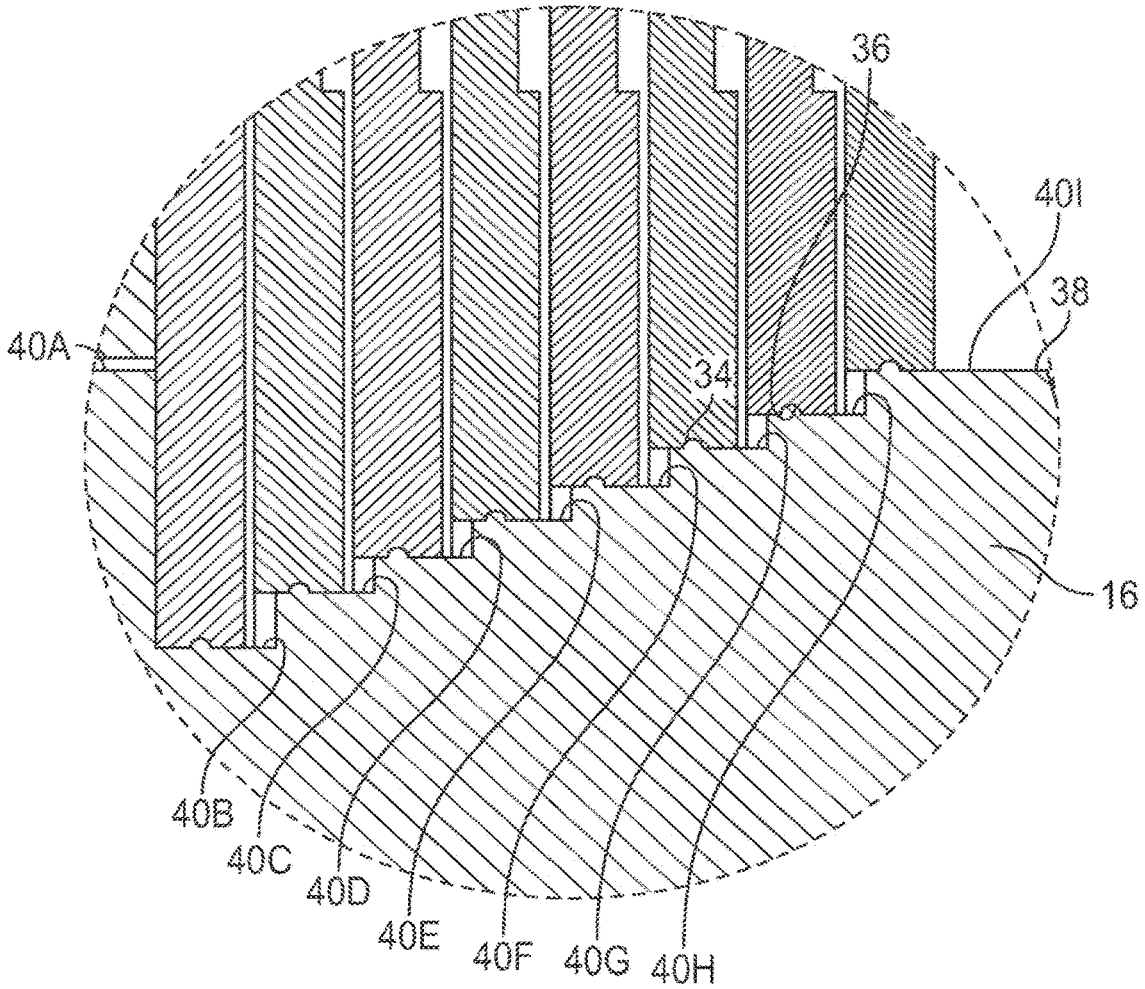
FIG. 11 is an enhanced cross-sectional view showing the bottom edge of the weight package seated upon the cradle.
Figure 12:
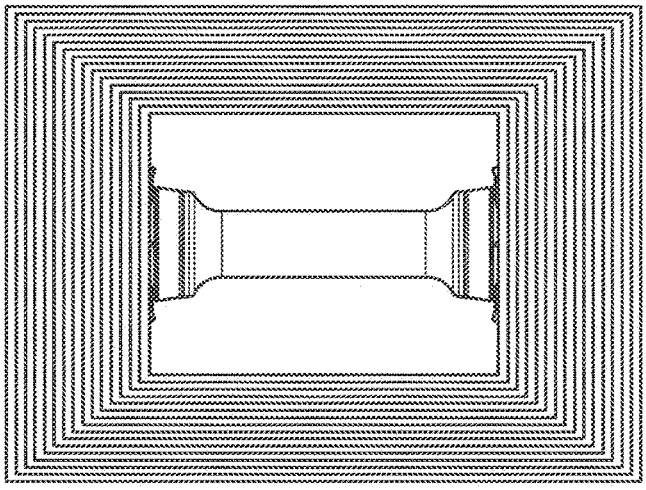
FIG. 12 is a top view showing a first alternative weight design useful in accordance with the teaching of the present invention.
Figure 13:
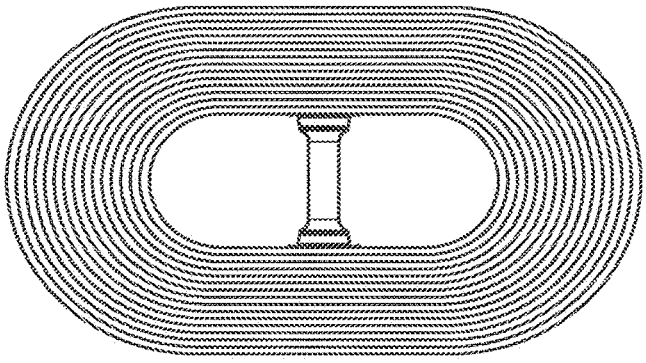
FIG. 13 is a top view showing a second alternative weight design useful in accordance with the teaching of the present invention.
Figure 14:
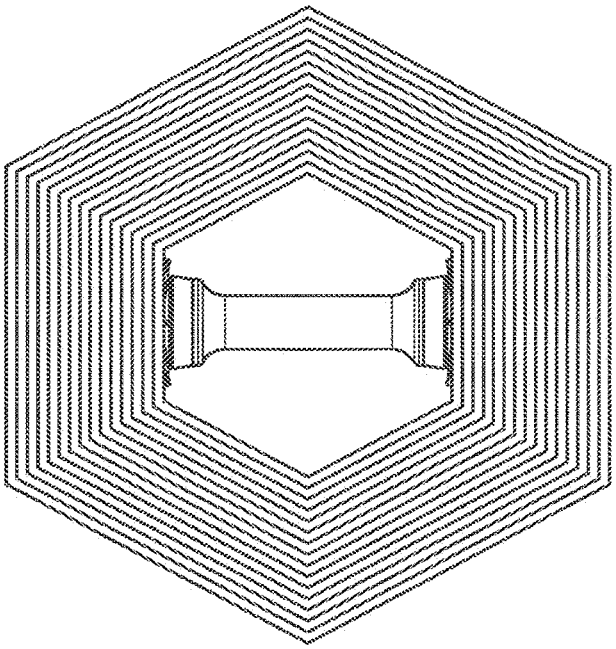
FIG. 14 is a top view showing a third alternative weight design useful in accordance with the teaching of the present invention.

As shown in FIG. 2, the weight package 14 includes a plurality of "stackable" weights 14A-141 arranged concentrically such that each weight forming part of the stack is positioned adjacent to another weight in the stack. As should be appreciated, by arranging the weights in this manner, substantial space savings can be accomplished. The weights 14A-141 may be in the form of rings having an overall cylindrical shape. Still other shapes are contemplated, including, for example, ovals, rectangles, squares, or polygons provided that they have mutually opposing sides, such as, for example, hexagons or octagons, some of which are shown in FIGS. 12-14. Each weight 14 generally includes a top edge 22, a bottom edge 24, and one or more side walls 26 having an inner wall 28 and an outer wall 30. Disposed along at least one side wall 26 of each weight is at least one through-hole 32. Optionally, each weight 14 will include a pair of spaced apart through holes 32A and 32B for hosting a weight supporting rods associated with the handle assembly, as will be discussed in greater detail below. The weights may also include a means for aligning the weight package upon the cradle 16 at a specific location. For example, such means may include cooperative male and female members, one on the cradle and one on each weight. Each weight may include a detent 34 disposed along the bottom edge 26 which sits upon an upwardly projecting tab 36 occurring on the weight supporting surface 38 of the cradle 16, as shown in FIG. 11. Optionally, the weights 14 may also include a flange 42 positioned in proximity to the top edge 22. The flange may be a relatively thin annular projection stacked one on top of another.

The weights may be formed from a number of different metals such as iron or stainless steel, by way of example. The weight can come in various weight increments such as 5 lbs. or 10 lbs. and may collectively have a weight package total of anywhere between 5 lbs. to 200 lbs., for example.

The handle assembly 12 may include first and second braces 50, 50A disposed along mutually opposing portions of the inner wall 28 of the inner-most weight 14A. The braces include a body 52 having first ends otherwise referred to as bases 54 which are fixedly attached adjacent to the inner wall may be contoured to match the shape of the inner wall. As shown in FIGS. 5-9, fasteners 42 such as spaced apart set screws may be utilized to capture the inner most weight 14A and connect it to the braces via threaded holes 44.

The end 54 opposite the base of each brace (e.g. second ends) include reduced annular portions 58, 58A. The central portion of the handle includes an external gripping surface 60 which may be knurled to enhance the user's grip. The handle 12 also includes enlarged ends 62, 62A having annular recesses 64, 64A which fit over the annular portions 58, 58A of the braces. The enlarged ends help to keep the user's hand disposed over the central portion of the handle.

Disposed over the enlarged ends 62, 62A may be a sleeve 88 to having numerical designations for each successive weight increment in the weight stack.

The braces 50, 50A also include a handle rotation drive assembly 90 and a handle rotation locking mechanism 110. Starting with the drive assembly 90, cavities 92, 92A are provided in the body of the braces between the reduced annular portion 58, 58A and the base 54. As shown, the cavities extend from the outer edge 94 to the inner annular edge 96 of the braces. Disposed within the cavities are a plurality of ball bearings 98 to assist in facilitating the rotation of the handle. More particularly, as the handle is rotated in the direction necessary to drive the internal rods outwardly, as shown best in FIGS. 6-9, the bearings drop into serpentine shaped slots contained on the external wall 100 of the shaft rod. With each complete revolution of the handle, another bearing 98 drops into the serpentine slot 102. Likewise, as the rod shaft is rotated in the opposite direction as the handle is sufficiently rotated, the bearings 98 re-enter the cavities 92, 92A. Upon full rotation, i.e. complete retraction of the rods into the elongated bore 68, the bearings 98 are forced back into cavities 92, 92A.

Figure 6:
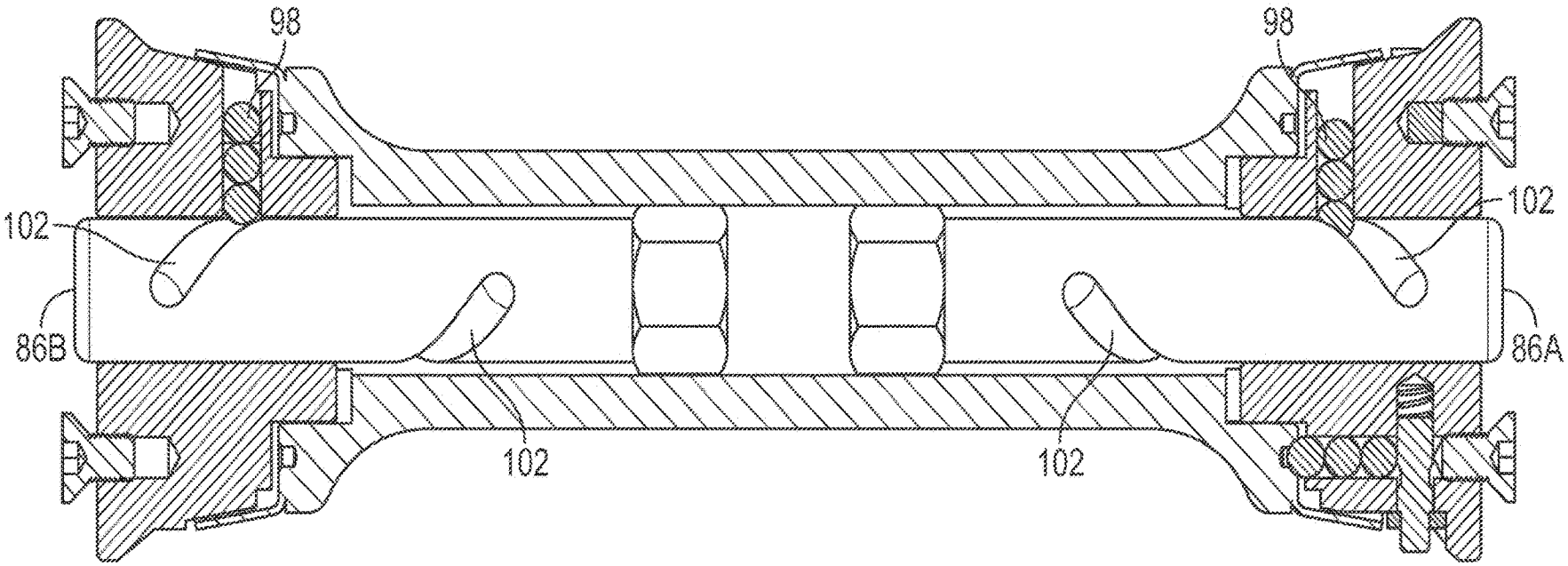
FIG. 6 is a side view of the internal handle assembly components of an adjustable center-mass weight assembly according to the present invention.

The handle 12 also includes a hollow elongated bore 68 for receiving rods 80, 80A used to capture weights from the weight package. The rods as shown include a head 82 and a shaft 84. The head is shaped to match the internal geometry of the bore 68. For example, in the current embodiment the head and internal symmetry are hexagonal in shape, as shown in FIG. 6. Of course, other geometries are anticipated. Preferably, the shape has straight edges which can be engaged by a matching wall of the elongated bore 68. The end of the rods 86 engage the through-holes 32A and 32B, as will be described below.

In order to allow for rotation of the handle and extension or retraction of the rods, the rotation locking mechanism 110 needs to be disengaged. Thus, referring to FIGS. 5-5B, the locking mechanism includes a horizontally disposed chamber 112 extending from the base 54 of the brace 50, a plurality of ball bearings 114 disposed within the chamber, an aperture 116 which intersects the chamber 112, a spring 118, and a pin 120 partially disposed within the aperture. The chamber 112 may be an extension of a screw hole 44 as shown. The pin 120 includes a first and 122 inserted into the aperture to engage the pre-inserted spring and a second and 124 which extends outwardly from the aperture opening 126. The distal portion 128 of the second and 124 is maintained in the aperture by a clip 130. The clip 130 includes a through-hole 132 for receiving the distal portion 128 of the second end. The pin 120 also includes an annular groove 136 along the outer surface between the first end and second end.

Figure 5:
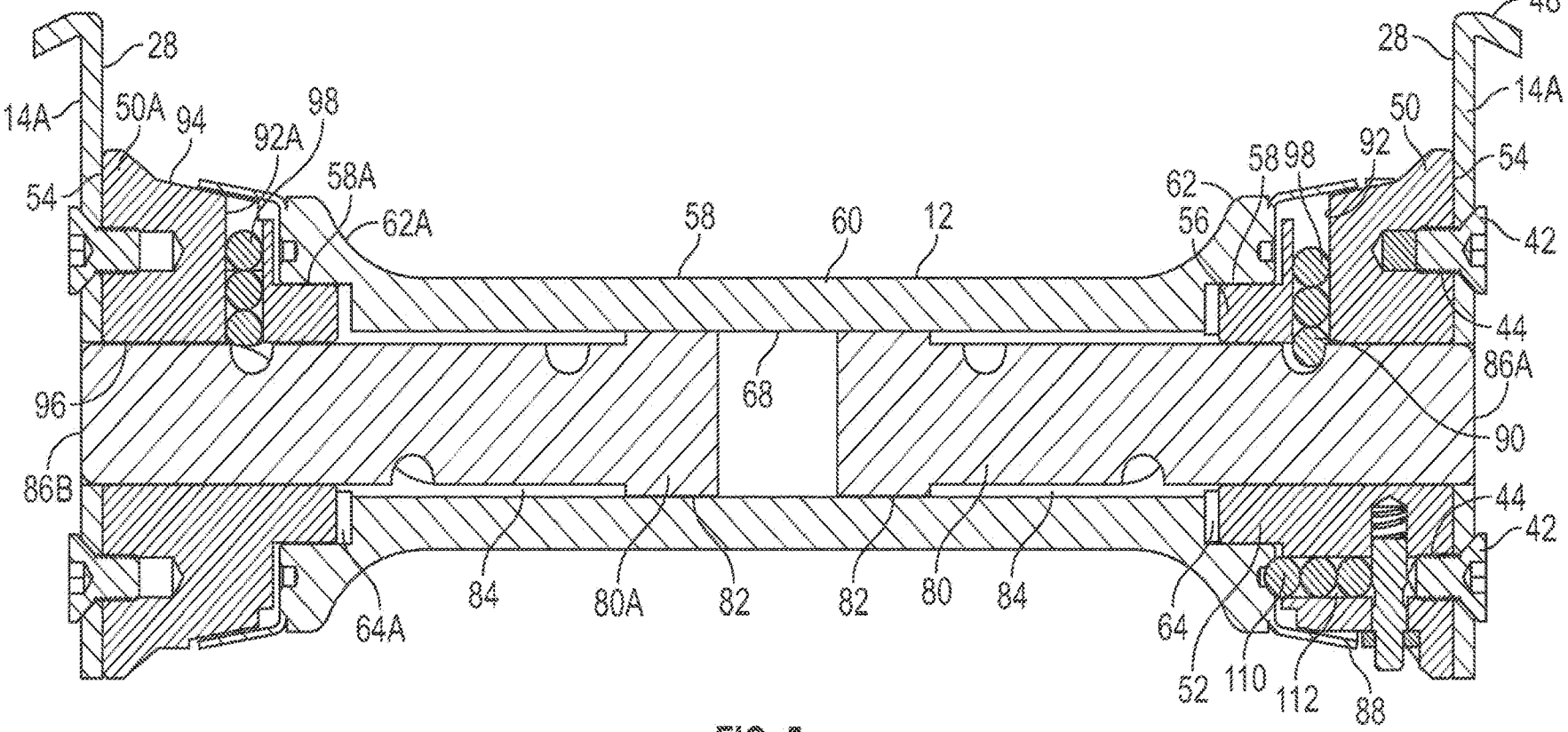
FIG. 5 is a cross-sectional view of the handle assembly of an adjustable center-mass weight assembly according to the present invention.
Figure 5A:
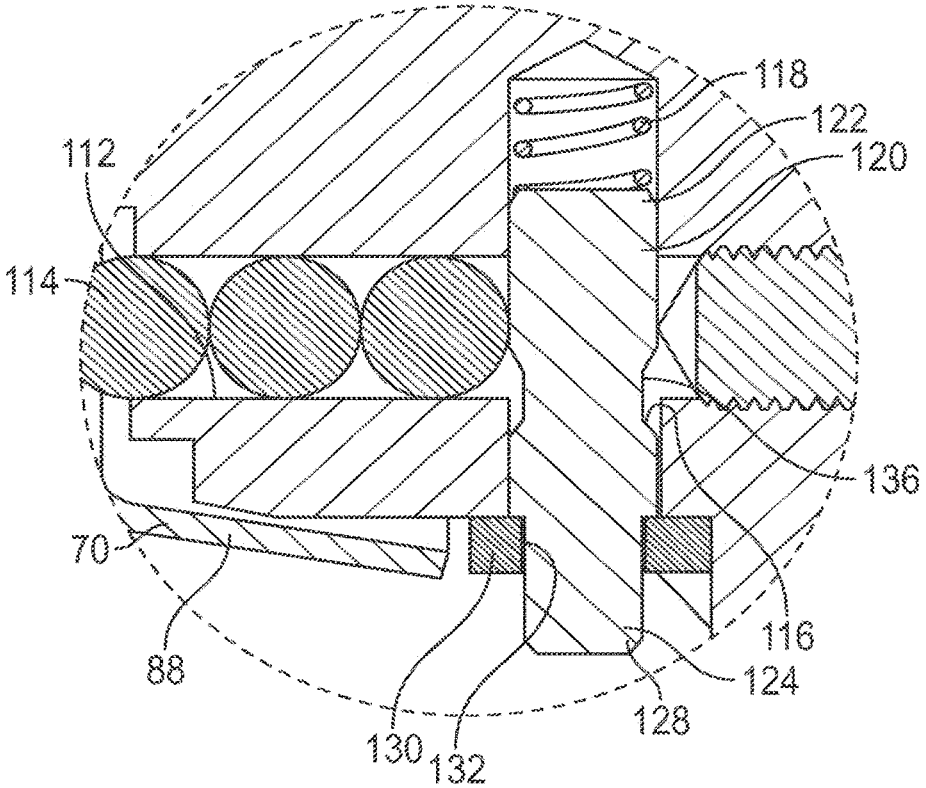
FIG. 5A is an enlarged cross-sectional view of the pin and ball bearing structure in a first position of an adjustable center-mass weight assembly according to the present invention.

With specific reference to FIGS. 5A and 5B, operation of the locking mechanism 110 will now be described. According to FIG. 5A, the locking mechanism is shown in the position when the handle assembly is removed from the cradle. When the handle assembly is out of the cradle, the pin 120 is forced downwardly by the spring 118 so that the ball bearings 114 are engaged by the thickest portion of the pin 120. In this position, the bearings are forced into forceful contact with the sleeve seventy such that the handle is incapable of rotation. This is the locked position.

Figure 5B:
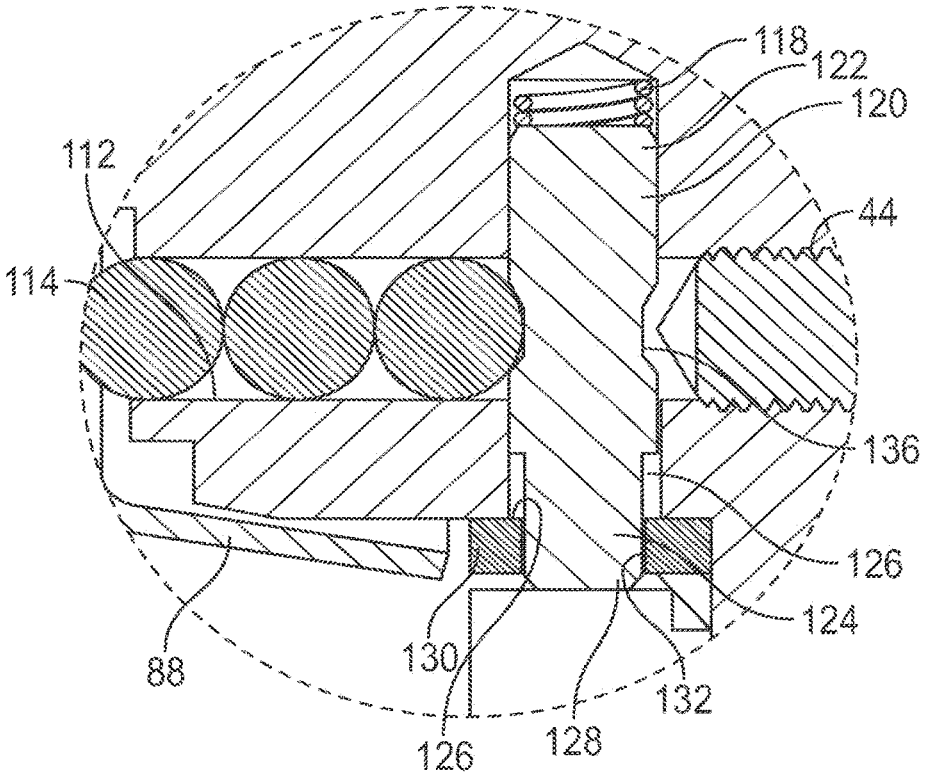
FIG. 5B is an enlarged cross-sectional view of the pin and ball bearing structure in a second position of an adjustable center-mass weight assembly according to the present invention.

In contrast, according to FIG. 5B, the locking mechanism is shown in a position where the handle assembly and weight stack associated there with are inserted on the cradle. When on the cradle, the pin 120 is forced upwardly into the aperture 116 thereby depressing spring 118. In this position, the pin is advanced such that the bearings can slide along the chamber and at least partially into the annular groove 136 of the pin. As a result, there is a sufficient amount of play to allow for rotation of the handle to engage or disengage weights in the stack. In this state the bearing stack has sufficient slack as to not preclude handle rotation.

Figure 7:
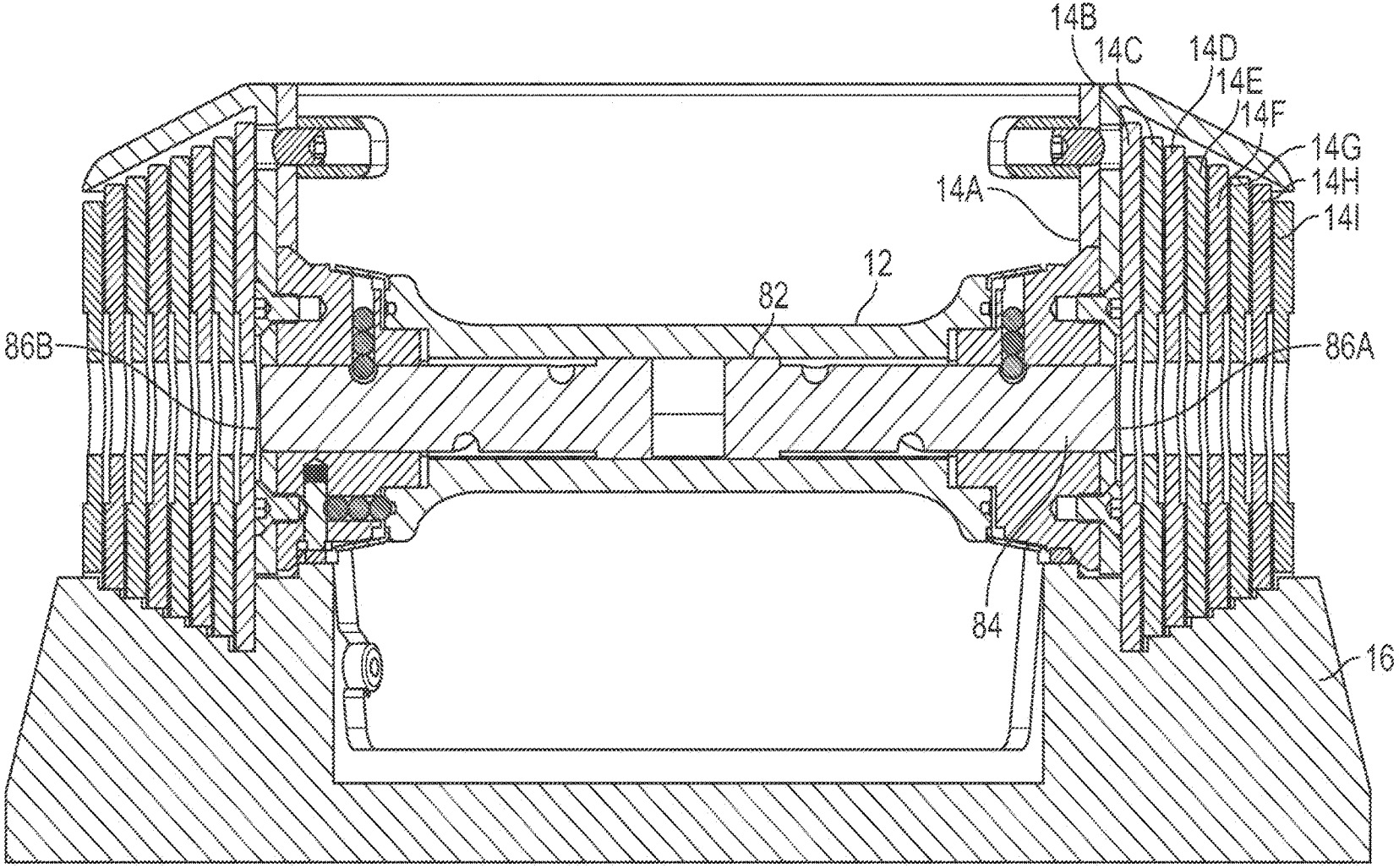
FIG. 7 is a cross-sectional view of the center-mass weight assembly with the handle in a first position.
Figure 8:
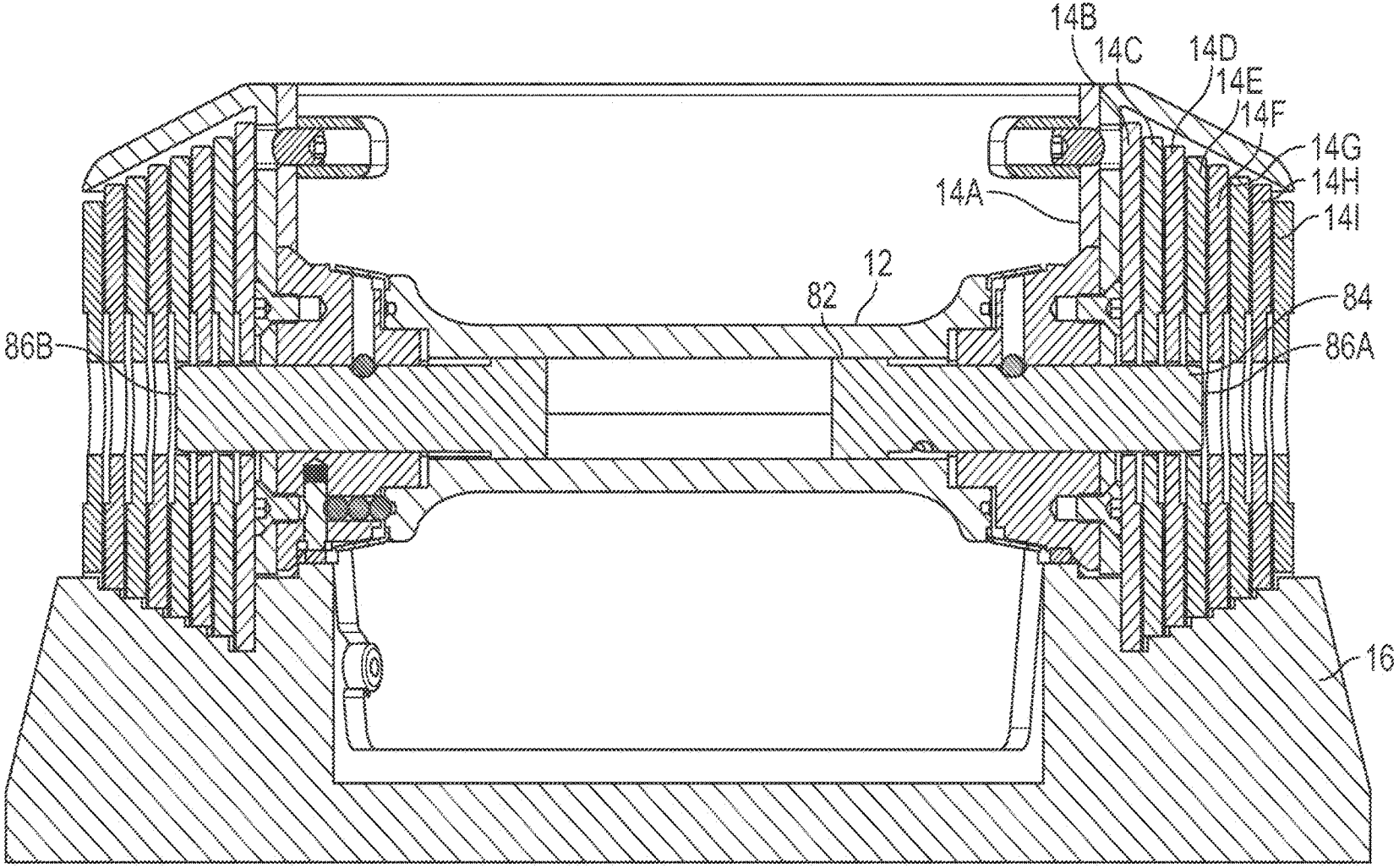
FIG. 8 is a cross-sectional view of the center-mass weight assembly with the handle in a second position.
Figure 9:
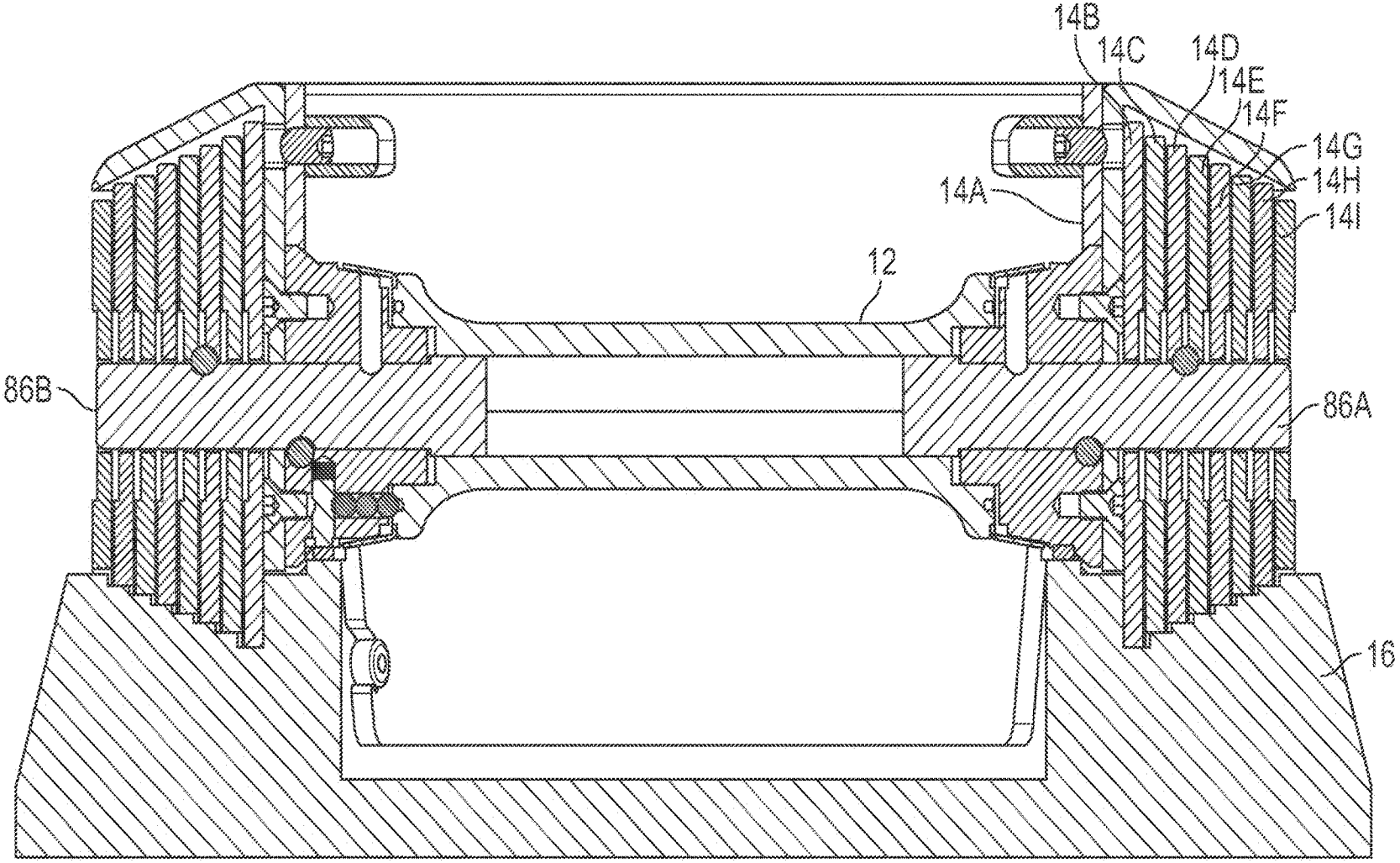
FIG. 9 is a cross-sectional view of the center-mass weight assembly with the handle in a third position.
Figure 10:
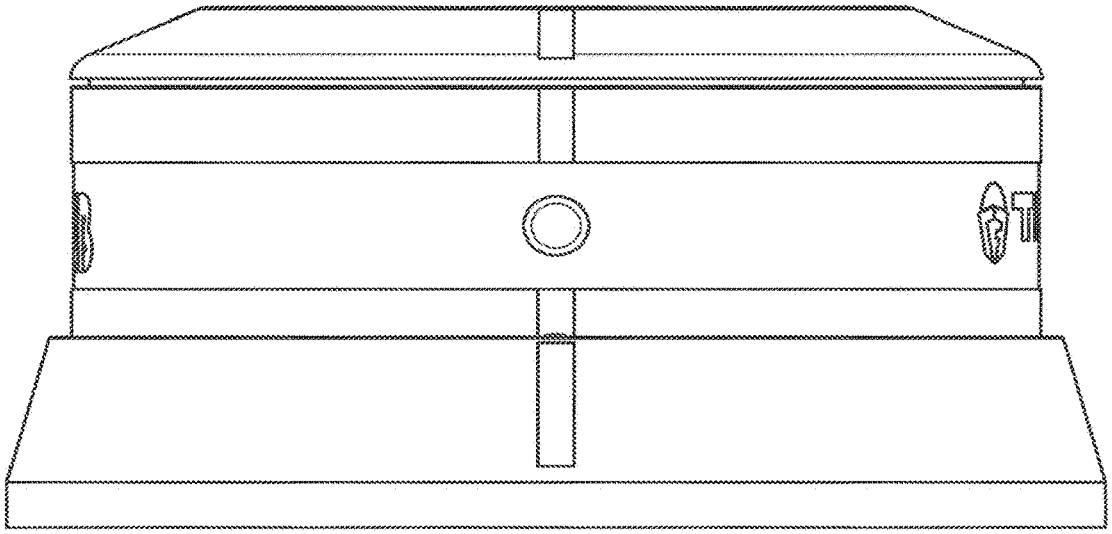
FIG. 10 is a side view of the center-mass weight assembly contained in the decorative cover.

FIGS. 7-9 show the weight stack engagement at different levels of handle rotation. For example, in FIG. 7 the handle is at the lowest level of rotation where the end 86 of the rod only captures the inner-most weight 14A. The end 86 is essentially extended equal to the outer wall of this weight. Under FIG. 8, the handle is rotated to the point where the rod engages a plurality of weights. In this position some of the bearings 98 are contained within the serpentine slot 102 between the rod and the internal bore 68. For example, weights 14A-14D are shown to be captured, i.e. hosted upon the rods. FIG. 9 shows the handle fully rotated to capture the full weight stack over the rods. In this position more of the bearings 98 are contained within the serpentine slot 102. Of course, while the serpentine slot is shown as occurring along the outer surface of the rods, it should be understood that the slots could optionally be provided along the wall of the handle's elongated bore.

Figure 15:
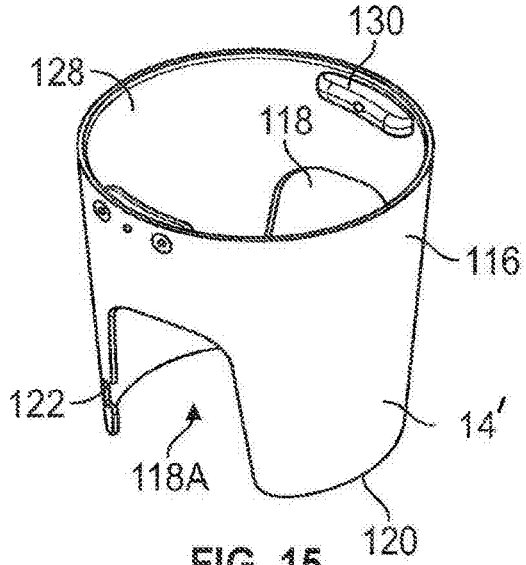
FIG. 15 is a perspective view of a supplemental weight for the center-mass weight assembly in accordance with the teachings of the present invention.
Figure 16:
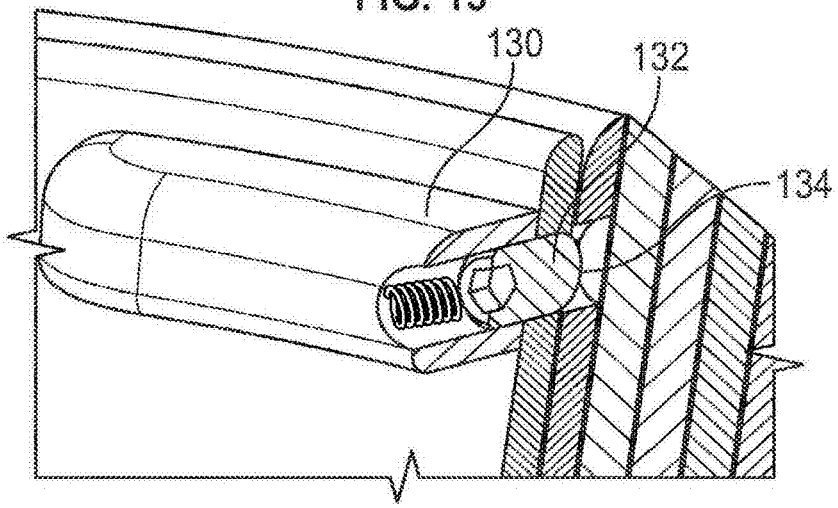
FIG. 16 is a partial cross-sectional view taken along lines 16-15 of FIG. 15.
Figure 17:
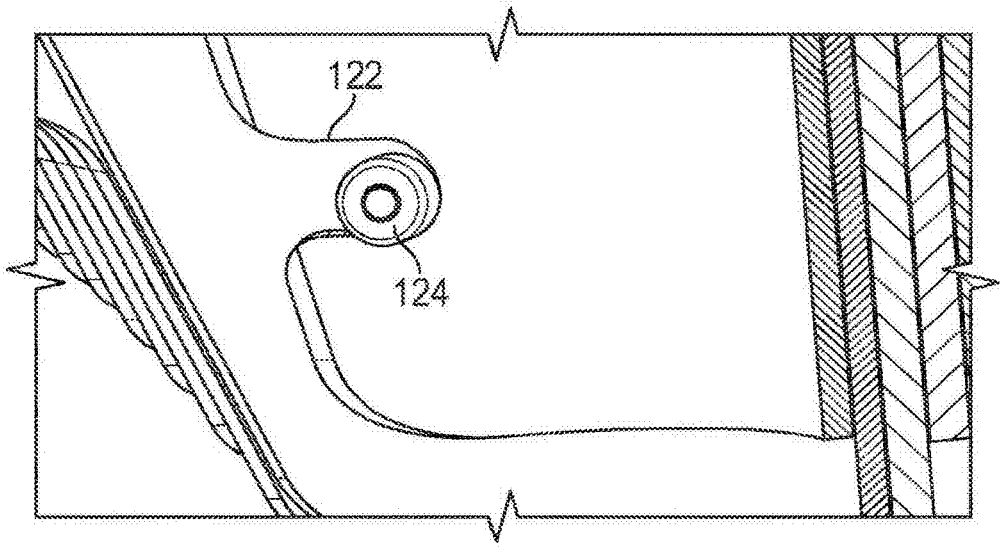
FIG. 17 is a partial cross-sectional view of the supplemental weight engaged within the inner-most weight.

Referring to FIGS. 15-17, a supplemental weight member 14' is shown which can be added to the weight package 14. The supplemental weight can be employed with any number of weights being used during a workout. While the supplemental weight can come in any one of a number of weight increments for purposes of example, the supplemental weight may be a five (5) pound (lbs.) increment. Thus, if the weight package 14 includes multiple ten (10) pound (lbs.) weights by using the supplemental weight, the full range of weights can be 10, 15, 20, 25, 30, 35, 40, 45, 50 lbs., etc. As should be appreciated by using a single supplemental weight the overall weight range for the center-mass weight assembly can be greatly increased.

Supplemental weight member 14' includes a substantially cylindrical shaped body 116 designed to fit closely within the inner-most weight 14A of the weight package 14. The body 116 includes opposing cut-out portions 118 and 118A extending upwardly from the bottom edge 120 sized to fit over the braces 50 and 50A. The cut-outs may include a slot 122 for engaging a stud 124 projecting inwardly from the inner wall of the inner-most weight 14A. The slot and stud arrangement serves to position the supplemental weight member 14' to become locked into place via spring loaded pegs 132 which are secured under handles 130. As shown in FIG. 16, the pegs 132 include a rounded tip 134 which extends into an aperture 140 occurring in proximity to the edge of the inner-most weight once the supplemental weight is inserted into the inner-most weight and partially rotated so that the slot 122 and stud 124 are engaged. The handles 130 can be mechanically or adhesively attached to the inner wall 128 of the supplemental weight member 14'.

The adjustable center-mass weight assembly disclosed above provides an improved solution compared to conventional dumbbells or existing adjustable dumbbell designs. It addresses the need for adjustable weight selection, ease of use, stability, and space-saving qualities in a single exercise equipment. The described invention allows users to perform a wide range of exercises, the potential to target different muscle groups and the ability to quickly add or subtract weights from the weight stack.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An adjustable center-mass weight assembly, comprising:

a plurality of concentrically arranged weights including an inner weight and one or more outer weights, said plurality of concentrically arranged weights each having a substantially tubular body including an inner wall defining an open area and an outer wall, said plurality of concentrically arranged weights each including at least one through-hole disposed along a common axis and said inner wall of said inner weight including at least one brace;

a handle assembly disposed within the open area of the inner weight and affixed to the inner wall thereof, said handle assembly including a selectively rotatable handle having an elongated inner bore and an external gripping portion and at least one selectively extendable rod disposed within the elongated inner bore of said selectively rotatable handle; and a handle rotation drive assembly including a cavity extending from an outer edge to an inner edge of the at least one brace, said cavity including a plurality of bearings disposed therein;

wherein upon rotation of said selectively rotatable handle in a first direction, the at least one selectively extendable rod is extended outwardly from said selectively rotatable handle into the at least one through-hole of one or more concentrically arranged weights of the plurality of concentrically arranged weights and upon rotation of said selectively rotatable handle in a second direction said at least one selectively extendable rod is retracted inwardly within the selectively rotatable handle disengaging the at least one through-hole of said one or more concentrically arranged weights.

2. The adjustable center-mass weight assembly of claim 1, wherein the at least one brace includes a first brace attached to the inner wall of the inner weight and a second brace spaced apart from the first brace and attached to the inner wall of the inner weight.

3. The adjustable center-mass weight assembly of claim 2, wherein said first brace and said second brace each include a body having a first end attached to said inner weight and a second end extending inwardly and away from the first end, wherein the selectively rotatable handle extends from the first brace to the second brace.

4. The adjustable center-mass weight assembly of claim 3, wherein said at least one selectively extendable rod includes a first rod contained within a first end of the handle and a second rod contained within a second end of the handle.

5. The adjustable center-mass weight assembly of claim 4, wherein the first rod and the second rod each include a head disposed within the elongated inner bore of said selectively rotatable handle and a shaft extending from the head.

6. The adjustable center-mass weight assembly of claim 5, wherein at least one of the elongated inner bore of said selectively rotatable handle or said first rod or said second rod include a slot for receiving the plurality of bearings as the selectively rotatable handle is rotated in a direction to extend the first rod or the second rod from the selectively rotatable handle.

7. The adjustable center-mass weight assembly of claim 6, wherein the slot has a serpentine shape.

8. The adjustable center-mass weight assembly of claim 5, wherein the head includes at least one edge which mates with a portion of the elongated inner bore of said selectively rotatable handle.

9. The adjustable center-mass weight assembly of claim 1, further comprising a handle locking mechanism housed within at least one of said first brace or said second brace, said handle locking mechanism including a selectively displaceable pin including a recessed portion, a compressible spring in contact with said selectively displaceable pin, and an adjustable bearing stack in contact with said selectively displaceable pin.

10. The adjustable center-mass weight assembly of claim 9, wherein when said selectively displaceable pin compresses the compressible spring and the selectively displaceable pin is sufficiently advanced within said first brace or said second brace to expose the recessed portion such that the adjustable bearing stack becomes slacked which allows the selectively rotatable handle to rotate.

11. The adjustable center-mass weight assembly of claim 10, wherein said selectively displaceable pin is displaced by a cradle when said adjustable center-mass weight assembly is disposed thereon.

12. The adjustable center-mass weight assembly of claim 1, further comprising a supplemental weight coupled to the inner weight.

13. The adjustable center-mass weight assembly of claim 12, wherein said supplemental weight seats within the inner weight.

14. The adjustable center-mass weight assembly of claim 13, wherein said supplemental weight includes cut-out portions extending from a bottom edge, said cut-out portions configured to fit over a first brace and a second brace of said at least one brace of said handle assembly.

15. An adjustable center-mass weight assembly, comprising:

a plurality of concentrically stacked weights including an inner weight and one or more outer weights, each of said weights including a top edge, a bottom edge, and a substantially tubular body portion having an inside wall, an outside wall and at least one through hole disposed along a common axis of the plurality of concentrically stacked weights;

a handle assembly including first and second braces attached along opposite sides of the inside wall of the inner weight and a selectively rotatable handle having a first end coupled to said first brace and a second end coupled to said second brace, and at least one selectively extendable rod disposed within said selectively rotatable handle;

a handle locking mechanism housed within at least one of said first brace and said second brace, said handle locking mechanism including a selectively displaceable pin including a recessed portion, a compressible spring in contact with said selectively displaceable pin and an adjustable bearing stack; and a cradle configured to hold said adjustable center-mass weight assembly;

wherein when said adjustable center-mass weight assembly is disposed upon said cradle the selectively displaceable pin is advanced within said first brace or said second brace such that said adjustable bearing stack engages the recessed portion of the selectively displaceable pin causing the adjustable bearing stack to become slacked thereby allowing for rotation of said selectively rotatable handle.

16. The adjustable center-mass weight assembly of claim 15, wherein said at least one selectively extendable rod includes a first rod contained within a first end of the selectively rotatable handle and a second rod contained within a second end of the selectively rotatable handle.

17. The adjustable center-mass weight assembly of claim 16, further comprising a handle rotation drive assembly.

18. The adjustable center-mass weight assembly of claim 17, wherein said handle rotation drive assembly includes cavities extending from an outer edge to an inner edge of each of the first brace and the second brace, said cavities having a plurality of bearings disposed therein.

19. The adjustable center-mass weight assembly of claim 18, wherein at least one of the elongated bore of said selectively rotatable handle or at least one of said first rod and said second rod include a slot for receiving the plurality of bearings as the selectively rotatable handle is rotated in a direction to extend at least one of said first rod or said second rod from the selectively rotatable handle.

20. The adjustable center-mass weight assembly of claim 19, wherein the slot has a serpentine shape.

21. The adjustable center-mass weight assembly of claim 16, wherein the first rod and the second rod each include a head disposed within an elongated inner bore of said selectively rotatable handle and a shaft extending from the head extendable through the selectively rotatable handle and said first brace or said second brace.

22. The adjustable center-mass weight assembly of claim 21, wherein the head includes at least one edge which mates with a portion of the elongated bore of said selectively rotatable handle.

23. The adjustable center-mass weight assembly of claim 15, further comprising a supplemental weight coupled to the inner weight.

24. The adjustable center-mass weight assembly of claim 23, wherein said supplemental weight seats within the inner weight.

25. The adjustable center-mass weight assembly of claim 24, wherein said supplemental weight includes cut-out portions extending from a bottom edge, said cut-out portions configured to fit over said first brace and said second brace of said handle assembly.

26. The adjustable center-mass weight assembly of claim 15, wherein upon rotation of the selectively rotatable handle in a first direction said at least one selectively extendable rod is extended outwardly away from the selectively rotatable handle into the at least one through hole of at least one of the one or more outer weights to engage said one or more outer weights on the at least one selectively extendable rod, and upon rotation of said selectively rotatable handle in a second direction, said at least one selectively extendable rod is retracted into the selectively rotatable handle and out of ene the at least one through hole to disengage the at least one of the one or more outer weights.

* * * * *